US005918295A

United States Patent [19]

Mueth

[11] Patent Number: 5,918,295

[45] Date of Patent: Jun. 29, 1999

[54] COMBINATION TABLE, DESK AND DIGITAL PIANO

[76] Inventor: Paul K. Mueth, P.O. Box 201, Lebanon, Ill. 62254

[21] Appl. No.: 09/122,465

[22] Filed: Jul. 27, 1998

[51] Int. Cl.[6] ..... G10C 3/02

[52] U.S. Cl. ..... 84/177; 84/178; D6/397

[58] Field of Search ..... 84/177, 178, 180; D6/397; D17/1, 2

[56] References Cited

U.S. PATENT DOCUMENTS

D. 294,438 3/1988 Page ..... D6/397

*Primary Examiner*—William M. Shoop, Jr.
*Assistant Examiner*—Shih-yung Hsieh
*Attorney, Agent, or Firm*—Don W. Weber

[57] ABSTRACT

A combination table, desk and digital piano is presented. The combination device features a flat writing surface with desk drawers which is made accessible by a folding top and side located at the front of the device. Located at the back of the device is a digital piano portion which is made accessible by folding back the top and side of the back portion of the device. When the digital piano portion is in the open position, the flat surface for a digital keyboard is made accessible and a hinged piano music marquee may be raised. The back portion also has a cut-out in the side of the body for speakers. When both the front desk portion and the rear back portion are closed, the device can be utilized as a flat table top.

7 Claims, 4 Drawing Sheets

COMBINATION TABLE, DESK AND DIGITAL PIANO

BACKGROUND OF THE INVENTION

This invention relates to the field of furniture and musical instruments. More particularly, a combination table, desk and digital piano with keyboard and speakers is presented.

Pianos come in many different sizes and shapes. Digital piano cabinets are generally adapted to fit the digital piano keyboard which is essentially rectangular, and the musical components of the piano keyboard, including the strings and foot pedals. Nearly all pianos serve a single function—to create music from the piano keyboard and pedals. Some pianos come in an attractive cabinet, while others, mostly digital pianos, may come in a combination of designs making the piano itself suitable for use as a table. However, even those piano cabinets which are designed for a second use have the drawback that they generally take the shape of a piano and are otherwise clearly recognizable as primarily a piano rather than a piece of furniture such as a table.

A piano often takes up a considerable and conspicuous place in a music room, parlor, or other room necessarily designated primarily for music. In such a room space is often lost when the room is not being used to play the piano. It is an object of this invention to provide a specialized piece of furniture which can be used to produce music by playing the piano but which can also be used as a writing desk, or table. Utilizing this device, the same area of a room may be used for three separate purposes.

While the top, flat portion of most pianos may be used essentially as a table, pianos are not designed to conceal their nature as a musical instrument when not in use. The visual concept of the room having a piano is thus always the same: a music room It is another object of this invention to provide a piano cabinet which may be readily transformed into a standard flat table for use as a secondary piece of furniture when the piano is not being played, or as a desk. This combination device will change the concept of use for rooms and architectural designs of residences.

While the environment of a music room is generally spacious and aesthetically pleasing, the piano dominates the architecture of the room and essentially limits the use of the room as a music room. However, it is often desired to utilize the space for other reasons, such as a writing desk. When the piano is not in use, using this combination device, the usual concept of a room may be readily changed from a music room, to a table, to a business purpose (a desk). It is a further object of this invention to provide a specialized piece of furniture that not only includes, in combination, a digital piano keyboard and speakers or a table, but which also includes a writing desk with a flat surface for writing and a number of drawers for storing stationery and other writing paraphernalia.

While many pieces of furniture serve a dual combination, the three-way combination use of the instant device as either a digital piano keyboard and speakers, a decorative table, or a writing desk with drawers is unique in this field. The different uses of the device is accomplished by means of a unique design utilizing both the front and back of the device as well as transforming the top from a flat surface to either a digital piano or a writing desk. Due to the unique nature of this device, may other important objects and aspects of this invention will become apparent when reading the below described specification.

BRIEF DESCRIPTION OF THE DEVICE

A combination table, desk and digital piano is presented, having an essentially flat upper surface and an essentially rectangular lower body. The upper surface and body are supported by four decorative legs. The front portion of the combination comprises a flat surface for writing and a plurality of drawers, which are accessed by raising the hinged desk cover and side and folding it back towards the opposite side of the device. On the back side of the device is a space which is adapted to receive a digital piano keyboard and speakers and to display a computer screen. This piano area is accessed by folding back the digital piano top and side. A piano pedal assembly is also provided. When both the desk portion and the piano portion are lowered in their closed position, the upper surface of the combination provides a flat, table-like appearance and functions as a furniture table.

BRIEF DESCRIPTION OF THE DRAWING FIGURES

DETAILED DESCRIPTION OF THE DEVICE

Figure 1:
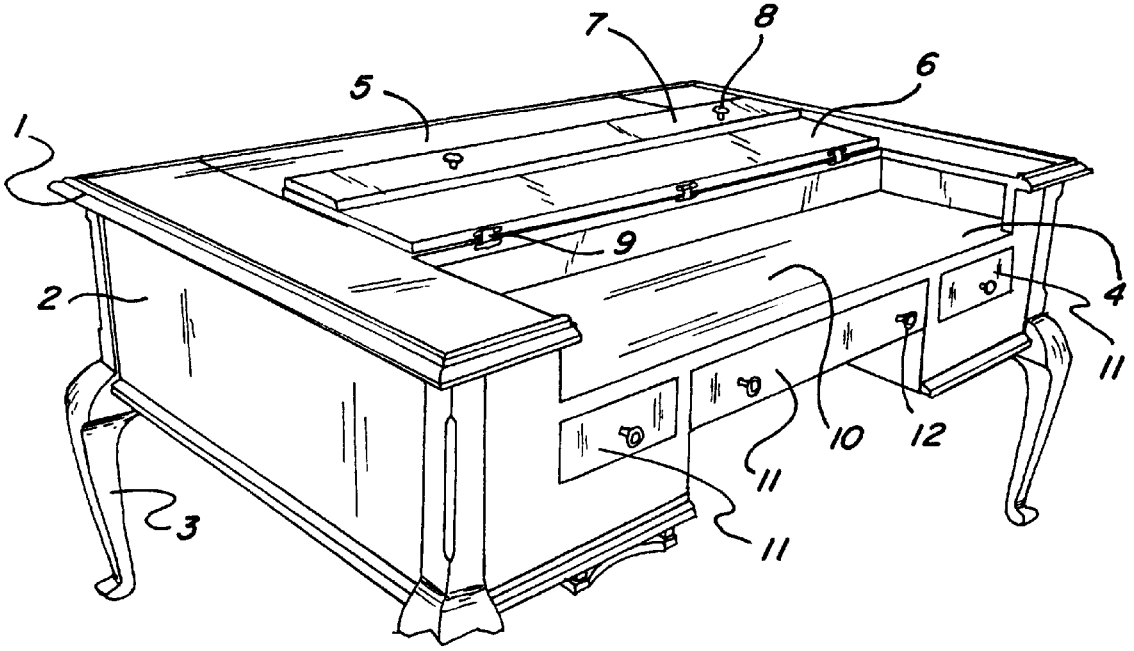
FIG. 1 is a partial perspective view of the combination shown with the desk portion in the open position.
Figure 2:
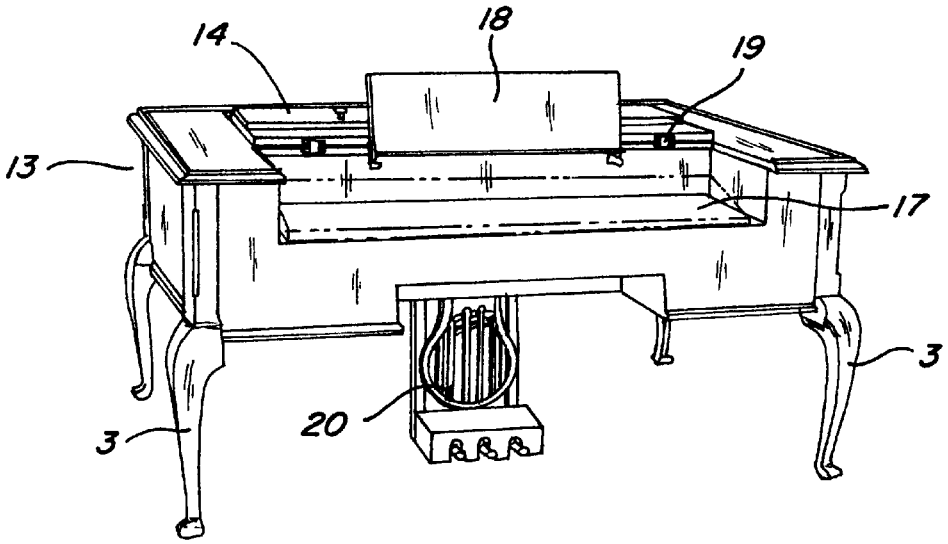
FIG. 2 is a perspective view of the combination shown with the digital piano portion in the open position.

A combination table, desk and digital piano is presented comprising an upper flat portion and a lower rectangular portion supported by four legs. The main essential portions of the device include an essentially flat top 1 and a lower essentially rectangular body 2. The rectangular body 2 has an essentially rectangular cross section. The top flat portion is approximately 1inch thick while the lower essentially rectangular body is approximately 1 foot 3 inches in thickness. The overall dimensions of the top and rectangular body would be approximately 3 feet 8 inches wide with a length of approximately 5 feet 8 inches. However, it should be remembered that these dimensions are meant for purposes of illustration only and are not meant as a limitation on the design structure or particular dimensions, which may vary according to the precise applications. The rectangular body 2 is supported by four legs 3 as shown in FIGS. 1 and 2.

The combination device includes a front desk portion 4 and a back digital piano portion 5. The arrangement and relationship of the desk and piano portions is best shown on FIGS. 3 and 6. The front desk portion 4 is best shown in FIGS. 1, 3, 5 and 6

Figure 5:
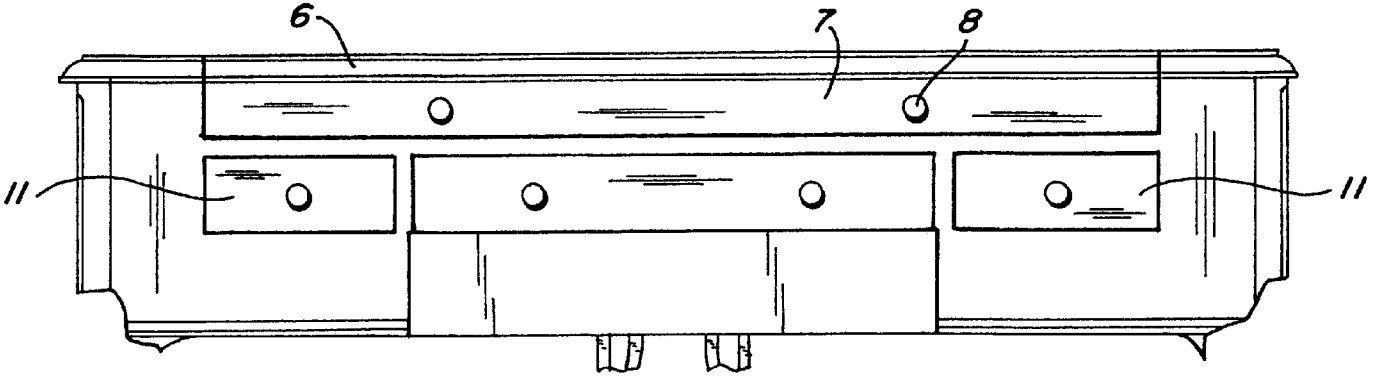
FIG. 5 is a partial front view of the device showing the desk portion of the device in the closed position.
Figure 6:
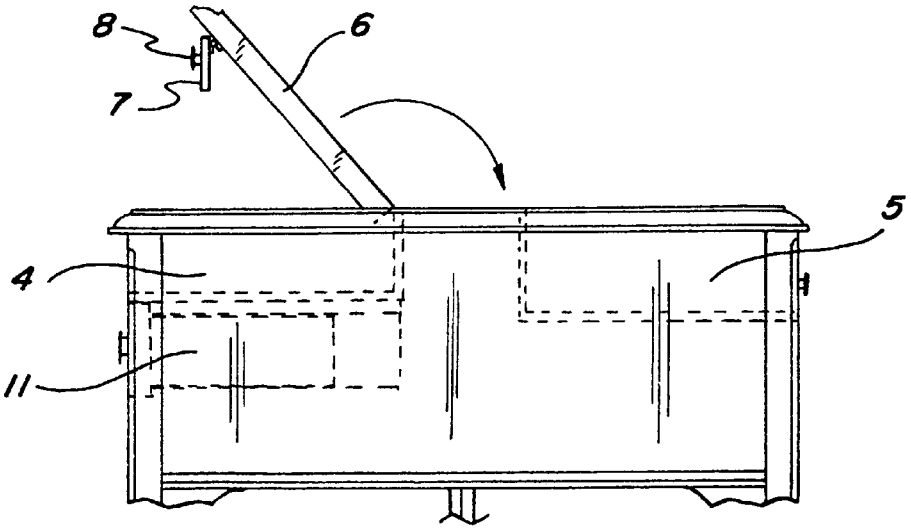
FIG. 6 is a partial left side view of the device showing the desk portion in the partially opened position.

The front desk portion is accessed by raising the hinged desk cover top 6. This hinged desk cover top 6 is attached to the top of the device by hinges and to a hinged desk cover side 7. When the desk portion is in the closed position (as best shown in FIG. 5) the desk cover top 6 is flat with the combination top 1. However, when the front desk cover is folded backwards (as shown in FIGS. 1 and 6) the desk portion of the device is accessed.

The hinged desk cover side 7 has a plurality of handles 8 which facilitate the opening and closing of the desk cover. The desk cover top 6 and the desk cover side 7 are connected by means of hinges 9. These hinges allow the desk cover to be folded backwards in the direction of the arrow, as shown in FIG. 6. When the desk cover top 6 and side 7 are folded completely backwards as shown in FIG. 1, the flat writing desk surface 10 is exposed.

Figure 3:
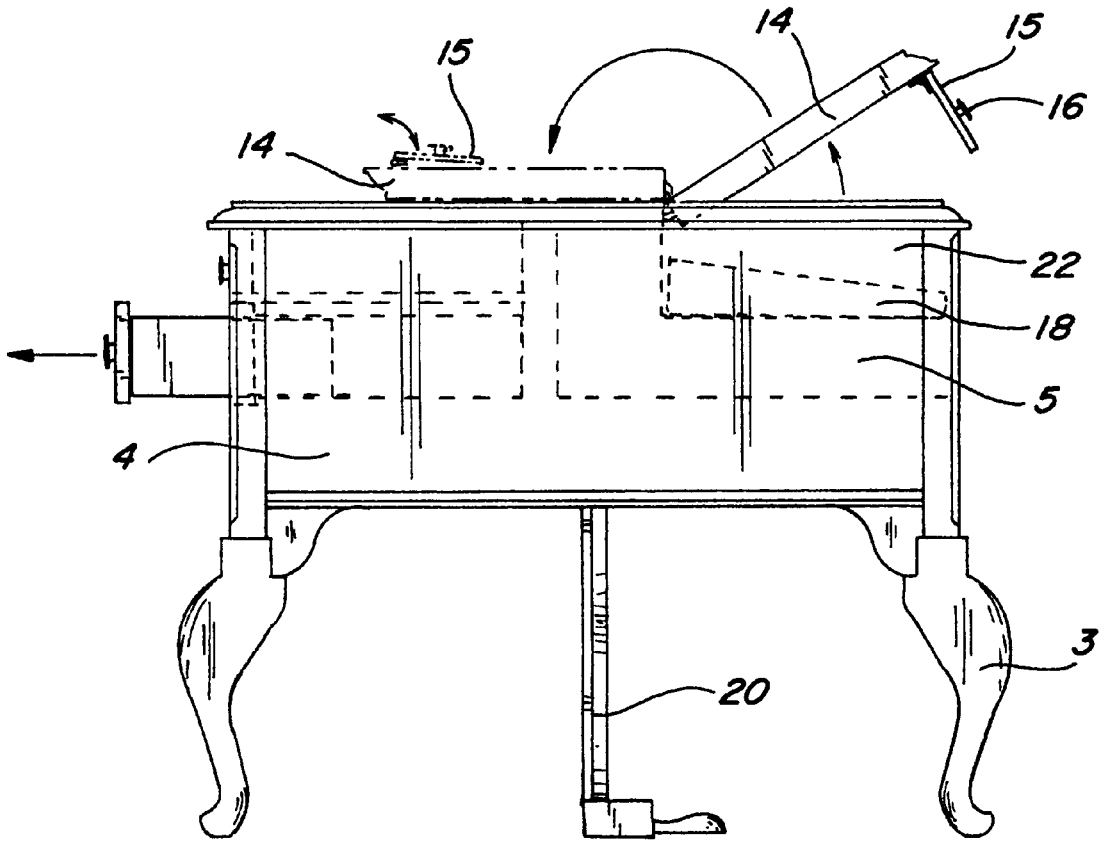
FIG. 3 is a right-side view of the combination showing both the desk portion and the digital piano portion.

The desk portion of the device has a flat writing surface 10 as well as a plurality of drawers 11 located below the writing surface. Each drawer is opened by means of drawer handles 12. As shown in FIGS. 3 and 6, the drawers are approximately 12 inches deep and recessed into the rectangular body 2.

On the side opposite the desk portion 4 is a back piano portion 5. This back piano portion 5 is best shown on FIGS. 2, 3, and 4. When the device is in the digital piano mode 13 a space is accessed which is adapted to receive a digital piano keyboard. The digital piano keyboard is accessed by folding the hinged piano cover top 14 in the direction of the arrow shown on FIG. 3. The fully opened piano mode is shown as dotted lines in FIG. 3. This hinged piano cover top 14 is connected by hinges to combination top 1 and to the piano cover side 15. The piano cover side 15 has handles 16 which facilitate accessing the digital piano portion.

As the digital piano top 14 and side 15 are folded in the direction of the arrow shown on FIG. 3, the top 14 and side 15 eventually come to rest as shown in FIG. 2. This accesses the keyboard area surface 17, an essentially rectangular area 22 which is sufficient in size to accommodate most standard digital piano keyboards and screens. Also provided within the digital piano area is a hinged piano music marguee stand 18 which may be folded upwards to an essentially vertical position as shown in FIG. 2. The piano cover top 14 and sides 15 are hingedly connected by piano cover hinges 19 as shown in FIG. 2. Also provided with the device is a lower piano pedal assembly 20.

Figure 4:
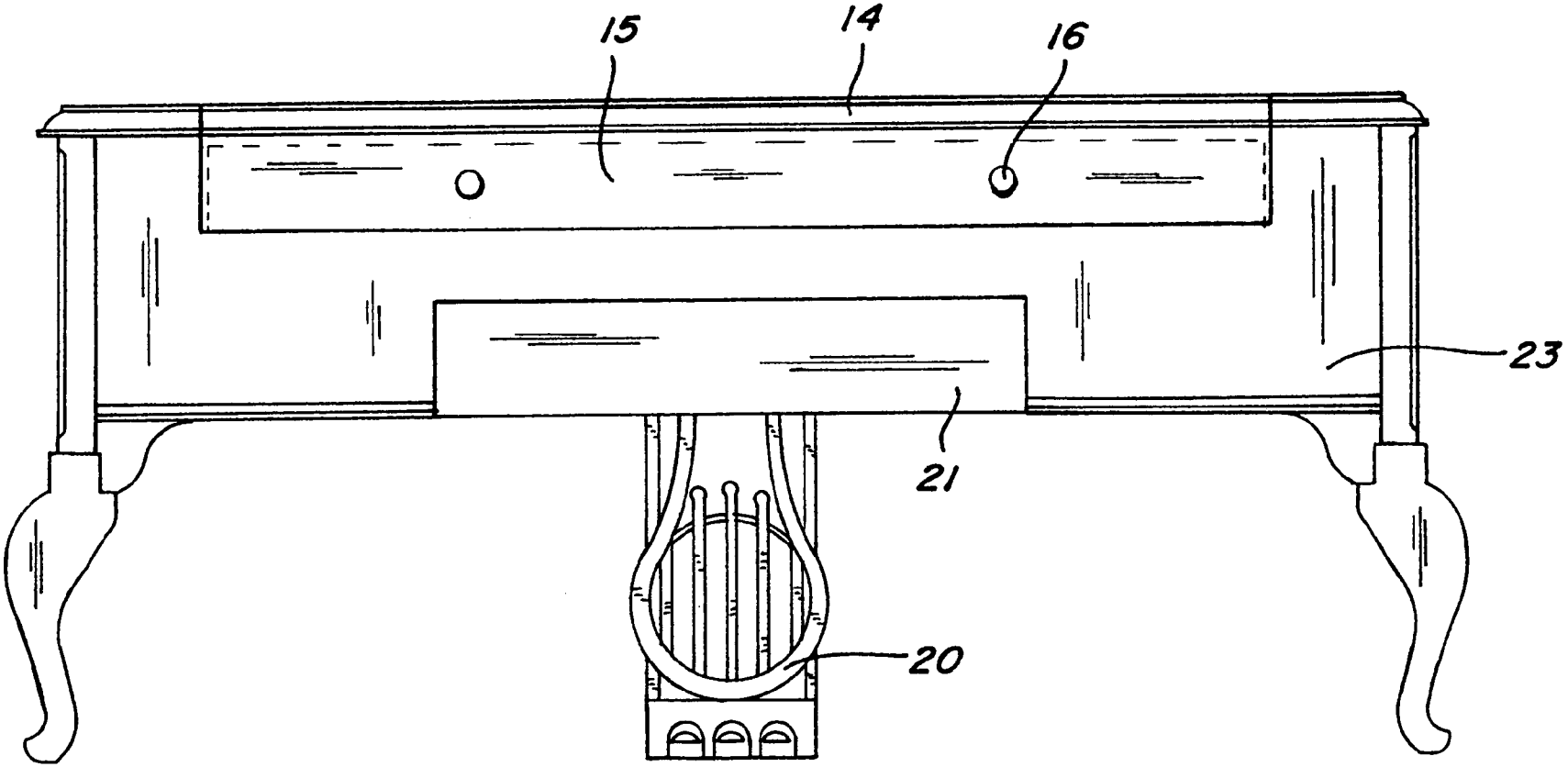
FIG. 4 is a back view of the device showing the digital piano portion in the closed position.

In order to provide space for digital speakers, a cut-out portion 21 is removed from the back edge 23 of the device as best shown in FIGS. 4 and 2. This cut-out area provides extra room for the musician or for speakers which may be placed in that area. The area is approximately 3 inches deep and 36 inches long, as shown in the drawing figures.

The device is meant to be used as either a desk or a digital piano, or, alternatively, as a table when both the desk and digital piano portions are in the closed positions. The front view of the device with the desk in the closed position (FIG. 5) and the back view of the device with the digital piano in the closed position (FIG. 4) provide a table with a flat surface. This flat table top surface in best shown in FIGS. 5 and 6.

The device thus provides a combination table, desk, and digital piano all in one compact and aesthetically pleasing piece of furniture. The unique arrangement between the front desk portion and the rear piano portion, as well as the flat table top which is presented when both the front and back portions are closed, creates a distinctive and novel piece of furniture which is both functional and decorative.

The device generally has the dimensions as indicated above. The device would normally be approximately 35 inches high and have space for a digital keyboard which is approximately 4 feet 7 inches by 2 feet 11 inches. However, the specific dimensions given herein may vary according to the precise design requirements specified by the manufacturer of the digital keyboard device and compatible with the area remaining for the desk writing surface area and drawers. These dimensions are given for illustration only and are meant as a limitation to this disclosure. While the device may be made in the decorative fashion as shown in the drawing figures, these figures are the preferred embodiment of the device and are not meant as a limitation to the invention disclosed. Obviously, other embodiments of the device comprising essentially these same components are within the spirit and disclosure of the insstant invention.

Having fully described my invention, I claim:

1. A combination table, desk and digital piano device capable of receiving a digital keyboard and speakers, comprising:

an essentially flat table top, connected to an essentially rectangular body having a front desk portion and a back piano portion, said rectangular body supported by a plurality of lower legs;

wherein the front desk portion of said device has a flat desk top hingedly connected to said table top and to a desk side, wherein said desk top and side are folded backward to open and access a flat desk surface; and wherein the back piano portion of said device has a flat piano top hingedly connected to said table top and to a piano side wherein said piano top and side are folded backward to open and access to an area for receiving said digital keyboard and;

wherein when both of said desk and piano tops are in the closed position a flat table top surface is presented.

2. The combination table, desk and digital piano device capable of receiving a digital keyboard and speakers as in claim 1, further comprising a plurality of desk drawers located in said front desk portion below said flat desk surface.

3. The combination table, desk and digital piano device capable of receiving a digital keyboard and speakers as in claim 1, further comprising desk side handles attached to said desk side.

4. The combination table, desk and digital piano device capable of receiving a digital keyboard and speakers as in claim 1, wherein said back piano portion has a cut-out to receive piano speakers.

5. The combination table, desk and digital piano device capable of receiving a digital keyboard and speakers as in claim 1, further comprising piano side handles attached to said piano side.

6. The combination table, desk and digital piano device capable of receiving a digital keyboard and speakers as in claim 1, further comprising a piano music marquee stand hingedly connected to said back portion within said piano keyboard area whereby said screen is raised to a flat, essentially vertical position.

7. The combination table, desk and digital piano device capable of receiving a digital keyboard and speakers as in claim 6, wherein said piano music marquee stand folds to the horizontal position when not in use.

* * * * *